US009198489B2

(12) United States Patent
Romero et al.

(10) Patent No.: US 9,198,489 B2
(45) Date of Patent: Dec. 1, 2015

(54) SYSTEMS AND METHODS FOR CUSTOMIZING HANDBAGS

(75) Inventors: Michelle Romero, West Valley City, UT (US); Annette B. Cavaness, Provo, UT (US); Christian J. Seegmiller, Riverton, UT (US)

(73) Assignee: Miche Properties, LLC, South Jordan, UT (US)

( * ) Notice: Subject to any disclaimer, the term of this patent is extended or adjusted under 35 U.S.C. 154(b) by 976 days.

(21) Appl. No.: 11/945,174

(22) Filed: Nov. 26, 2007

(65) Prior Publication Data

US 2008/0230158 A1 Sep. 25, 2008

Related U.S. Application Data

(60) Provisional application No. 60/895,758, filed on Mar. 20, 2007.

(30) Foreign Application Priority Data

Nov. 21, 2007 (WO) ..... PCT/US2007/85339

(51) Int. Cl.

| | |
|---|---|
| ***A45C 3/08*** | (2006.01) |
| ***A45C 1/02*** | (2006.01) |
| *A45C 13/26* | (2006.01) |

(52) U.S. Cl.
CPC ... *A45C 1/02* (2013.01); *A45C 3/08* (2013.01); *A45C 13/26* (2013.01)

(58) Field of Classification Search
CPC ..... A45C 3/08; A45C 3/06; A45C 13/08; A45C 13/02; A45C 7/0086
USPC ..... 150/105, 104, 118, 103, 100; D3/318, D3/232, 233, 240; 206/457
See application file for complete search history.

(56) References Cited

U.S. PATENT DOCUMENTS

| | | | |
|---|---|---|---|
| 840,086 | A | 1/1907 | Oswald |
| 1,042,934 | A | 9/1912 | Levy |

(Continued)

FOREIGN PATENT DOCUMENTS

| | | |
|---|---|---|
| CA | 2570857 | 1/2006 |
| FR | 1117240 | 5/1956 |

(Continued)

OTHER PUBLICATIONS

International Search Report, PCT/US2007/085339, Mailed Mar. 14, 2008.

(Continued)

*Primary Examiner* — Fenn Mathew
*Assistant Examiner* — Cynthia Collado
(74) *Attorney, Agent, or Firm* — Workman Nydegger

(57) ABSTRACT

A handbag can be easily redesigned with attachable/detachable handbag covers of virtually any design. The configurable handbag can similarly be configured to interchange various different handbag handles, also of any design. Accordingly, a handbag can be easily customized in both look and feel without necessarily requiring the purchase of multiple different handbags of different styles. In particular, a user can purchase a single (or few) base handbag(s), and alternatively purchase multiple different handbag covers and/or handbag handles to customize the handbag. The handbag covers are relatively small, and can be easily stored. In at least one implementation, the handbag covers are a tri-folding component that is attachable via magnetic fasteners.

6 Claims, 6 Drawing Sheets

(56) References Cited

U.S. PATENT DOCUMENTS

| | | | | | |
|---|---|---|---|---|---|
| 1,960,396 | A | | 5/1934 | Rosenberg | |
| 1,972,577 | A | | 10/1934 | Walinsky | |
| 1,978,971 | A | | 10/1934 | Thornhill et al. | |
| 2,023,144 | A | | 12/1935 | Miller | |
| 2,104,439 | A | | 5/1938 | Schein | |
| 2,118,400 | A | | 5/1938 | Goldberg | |
| 2,131,382 | A | | 9/1938 | Lobat | |
| D129,151 | S | | 8/1941 | Lewis | |
| D131,188 | S | | 1/1942 | Lewis | |
| 2,369,239 | A | | 2/1945 | Khoury | |
| 2,369,482 | A | | 2/1945 | Morris | |
| 2,437,382 | A | | 9/1948 | Czap | |
| 2,464,312 | A | | 3/1949 | Holden | |
| 2,477,388 | A | | 7/1949 | Moore | |
| D155,608 | S | | 10/1949 | Hilf | |
| 2,622,647 | A | | 12/1952 | Arnthal | |
| 2,627,885 | A | | 2/1953 | Cassell | |
| 2,656,870 | A | | 10/1953 | Wishnia | |
| 2,779,373 | A | | 1/1957 | Koepke | |
| 2,809,685 | A | * | 10/1957 | Lowy | 150/105 |
| 2,893,457 | A | | 7/1959 | Wilson | |
| 3,182,701 | A | * | 5/1965 | Ginsburg | 150/105 |
| 3,234,985 | A | | 2/1966 | Gilbert | |
| 3,451,454 | A | | 6/1969 | Davis | |
| 3,451,545 | A | | 6/1969 | Davis | |
| 3,556,187 | A | | 1/1971 | Speakes | |
| 3,575,226 | A | | 4/1971 | Chapman | |
| D224,072 | S | | 6/1972 | Rosenblum | |
| 3,669,169 | A | | 6/1972 | Lubliner | |
| 4,088,167 | A | | 5/1978 | Schwartz | |
| 4,112,991 | A | | 9/1978 | Barbaresi | |
| 4,260,004 | A | | 4/1981 | Domke | |
| 4,263,951 | A | | 4/1981 | Siegel | |
| 4,610,286 | A | | 9/1986 | Cyr | |
| 4,754,790 | A | | 7/1988 | Meyers | |
| 4,842,032 | A | | 6/1989 | Mastronardo | |
| 4,907,633 | A | | 3/1990 | Eckstein | |
| 5,096,030 | A | | 3/1992 | Espinosa | |
| 5,178,198 | A | | 1/1993 | Fitzgerald | |
| D334,661 | S | | 4/1993 | Kohn | |
| 5,207,254 | A | | 5/1993 | Fromm | |
| 5,356,004 | A | | 10/1994 | Weinreb | |
| 5,533,558 | A | | 7/1996 | Carey et al. | |
| 5,725,039 | A | * | 3/1998 | Macinai et al. | 150/104 |
| 5,765,618 | A | * | 6/1998 | Toledano | 150/107 |
| 5,829,502 | A | | 11/1998 | Distefano et al. | |
| 5,839,138 | A | | 11/1998 | Weidman et al. | |
| D403,863 | S | | 1/1999 | Briganti | |
| D408,146 | S | | 4/1999 | Briganti | |
| 5,894,975 | A | | 4/1999 | Holden et al. | |
| 5,911,262 | A | | 6/1999 | Steinhart | |
| 5,983,969 | A | | 11/1999 | Morgan | |
| 6,003,573 | A | | 12/1999 | Owens | |
| 6,029,723 | A | | 2/2000 | Baquero et al. | |
| 6,116,412 | A | * | 9/2000 | Rogers | 206/5 |
| D432,310 | S | | 10/2000 | Salz | |
| 6,129,126 | A | | 10/2000 | Restivo | |
| 6,173,837 | B1 | | 1/2001 | Marconi | |
| 6,179,025 | B1 | | 1/2001 | Sutton | |
| D437,687 | S | | 2/2001 | Salz | |
| 6,186,201 | B1 | | 2/2001 | Salz | |
| 6,237,660 | B1 | | 5/2001 | Giardino | |
| D443,139 | S | | 6/2001 | Salz | |
| D443,764 | S | | 6/2001 | Salz | |
| D444,943 | S | | 7/2001 | Nastasi | |
| 6,394,157 | B2 | * | 5/2002 | Luna | 150/113 |
| 6,422,278 | B1 | | 7/2002 | Grogan | |
| 6,446,688 | B1 | | 9/2002 | Sutton | |
| 6,543,499 | B2 | * | 4/2003 | McCreery | 150/104 |
| D476,809 | S | | 7/2003 | Ko | |
| D495,877 | S | | 9/2004 | Thorsen | |
| 6,796,344 | B2 | * | 9/2004 | Chen et al. | 150/113 |
| 6,807,992 | B2 | | 10/2004 | Powers | |
| D497,716 | S | | 11/2004 | de Baschmakoff | |
| 6,820,664 | B1 | | 11/2004 | Ritch | |
| 6,968,880 | B2 | | 11/2005 | Battaglia et al. | |
| 6,971,424 | B1 | | 12/2005 | Angevine | |
| 7,028,730 | B2 | | 4/2006 | Pace et al. | |
| 7,222,649 | B1 | | 5/2007 | Fox | |
| 7,246,643 | B2 | | 7/2007 | Andrews | |
| 7,461,676 | B2 | | 12/2008 | Huie | |
| 7,624,777 | B2 | | 12/2009 | Paller | |
| D610,081 | S | | 2/2010 | DeSorbo | |
| 7,789,114 | B2 | | 9/2010 | Pace et al. | |
| 7,942,296 | B1 | | 5/2011 | Johnson | |
| 2001/0015248 | A1 | | 8/2001 | McCreery | |
| 2002/0029831 | A1 | | 3/2002 | Pendergrass | |
| 2002/0066505 | A1 | | 6/2002 | Grogan | |
| 2003/0000612 | A1 | | 1/2003 | Sutton | |
| 2003/0177664 | A1 | | 9/2003 | Monassebian | |
| 2004/0050468 | A1 | | 3/2004 | Powers | |
| 2004/0187988 | A1 | | 9/2004 | Andrews | |
| 2005/0028908 | A1 | | 2/2005 | Schaus et al. | |
| 2005/0173034 | A1 | | 8/2005 | Antrobus | |
| 2005/0274441 | A1 | | 12/2005 | Pace et al. | |
| 2006/0021684 | A1 | | 2/2006 | DeCoro, III | |
| 2006/0157175 | A1 | | 7/2006 | Pace et al. | |
| 2006/0174984 | A1 | | 8/2006 | Burns | |
| 2006/0208043 | A1 | | 9/2006 | Plantan | |
| 2006/0237106 | A1 | * | 10/2006 | Pearson | 150/128 |
| 2006/0266452 | A1 | | 11/2006 | Huie | |
| 2006/0278311 | A1 | | 12/2006 | Mittelstaedt | |
| 2007/0163689 | A1 | * | 7/2007 | Pace et al. | 150/105 |
| 2007/0209742 | A1 | | 9/2007 | Morgan | |
| 2007/0221136 | A1 | * | 9/2007 | Buttner | 119/497 |
| 2007/0240798 | A1 | * | 10/2007 | Bihler | 150/102 |
| 2008/0006355 | A1 | | 1/2008 | Gomez | |
| 2008/0185082 | A1 | | 8/2008 | Mejia et al. | |
| 2008/0230158 | A1 | | 9/2008 | Romero et al. | |
| 2009/0065110 | A1 | | 3/2009 | Cassella | |
| 2009/0188592 | A1 | | 7/2009 | Connacher et al. | |
| 2011/0000590 | A1 | | 1/2011 | Welch | |
| 2011/0005646 | A1 | | 1/2011 | Nelson | |
| 2011/0011503 | A1 | | 1/2011 | Parker | |
| 2011/0061778 | A1 | | 3/2011 | Micone | |

FOREIGN PATENT DOCUMENTS

| | | | |
|---|---|---|---|
| GB | 2350285 | A | 11/2000 |
| GB | 2377882 | A | 1/2003 |
| JP | 2002051816 | | 2/2002 |
| KR | 20-20030050218 | | 5/2004 |
| KR | WO2005008552 | A1 | 1/2005 |
| WO | WO01/91596 | A1 | 12/2001 |
| WO | WO2006/002005 | A2 | 1/2006 |
| WO | WO2006/002005 | A3 | 1/2006 |
| WO | WO2006/122197 | A2 | 11/2006 |

OTHER PUBLICATIONS

"The Smart Handbag," Pattern #601, created by Eliza Jane Smart, Bernina Connection, LLC, 2 pgs. [online] [retrieved on Mar. 21, 2007]. Retrieved from the Internet URL: http://berninaconnection.com/cgi-bin/Store/store.cgi?product=patterns_main&productid=0 . . . .

"Rock Album Cover Tote Bag," created by Meg Musick-Makely, eco-artware.com, 2 pgs. [online] [retrieved on Mar. 21, 2007]. Retrieved from the Internet URL: http://www.eco-artware.com/catalog/MMM1-album-tote.shtml.

European Search Report, Application Serial No. 09014069.0-1258/2163169, Mailed May 3, 2010.

European Search Report, 07845129.1-1258/2124666, Mailed Mar. 25, 2010.

* cited by examiner

SYSTEMS AND METHODS FOR CUSTOMIZING HANDBAGS

CROSS-REFERENCE TO RELATED APPLICATIONS

The present invention is a U.S. National Stage Patent Application corresponding to PCT Application No. PCT/US2007/85339, filed on Nov. 21, 2007, entitled "Systems and Methods for Customizing Handbags," which claims the benefit of priority to U.S. Provisional Patent Application No. 60/895,758, filed on Mar. 20, 2007, also entitled "Systems and Methods for Customizing Handbags." The entire contents of each of the aforementioned applications is incorporated by reference herein.

BACKGROUND OF THE INVENTION

1. The Field of the Invention

This invention relates to systems, methods, and apparatus for customizing handbags, at least in part with interchangeable handbag outer-coverings.

2. Background and Relevant Art

Handbags, despite being useful for carrying various items, are often deemed to be an accessory item. For example, due to the wide variety of handbag styles a user can presently purchase, a user might choose to purchase or use a handbag as much for functionality as for a certain desired aesthetic. In particular, some people may even change handbags just to suit a particular outfit.

While the fact that handbags come in different styles can be useful for a number of different people, simply purchasing many different handbags to suit any number of different unique outfit choices can present a challenge. For example, a user may be faced with a problem of how to save and/or store all the various handbags that may be purchased. In particular, those that choose to purchase several handbags (for different outfits, or for other reasons) may find that the handbags have taken over the space in a closet. Often times, this may force the user to make decisions about getting rid of handbags unnecessarily.

In other cases, purchasing or using several different handbags can cause other logistical issues based on switching handbags. For example, anytime a user wants to use a different handbag for whatever reason (e.g., change in environment, outfit, etc.), the user may need to spend some time transferring the items from one handbag to another. This can result in various levels of inconvenience just to satisfy aesthetic ends.

Conventional mechanisms for interchanging handbag covers tend to be inconvenient to use. For example, some conventional systems employ interchangeable handbag covers that are meant to cover an entire base handbag. In most cases, these interchangeable covers are configured to cover each outside surface of the base handbag. Furthermore, these interchangeable covers are configured to provide a snug fit about the dimensions of the base handbag. Such particular fitting between handbag covers and base handbags can provide its own set of challenges, such as the fact that specially-sized handbag covers are limited in the types and sizes of base handbags they can be used to cover. In particular, base handbags that are too small or too large for a given handbag cover will result in the handbag cover coming off too often, or not fitting on the base handbag at all. One will appreciate that such disparities in fitting can be particularly pronounced with flexible base handbags that may vary greatly in size and shape depending on the number of items inside the base handbag.

Thus, such conventional systems may additionally or alternatively often include additional fasteners to hold the given handbag cover about the base handbag. Such fasteners generally include complex hook and loop systems, snapping elements, zipper elements, or even buckling arrangements. Some fasteners can be even more elaborate than these, and can include multiple fastening elements in a handbag frame built along each corner of the given handbag. In these or other similar cases, therefore, to exchange a handbag cover, the user will generally need to unbuckle each buckle element, unzip each zipper element, unfasten each given snap or hook and loop element, or otherwise unfasten the given frame, and then slide the handbag cover off the base handbag. One will appreciate that, while more elaborate fastening systems might hold the handbag cover in place more securely, such fastening systems can also defeat the convenience otherwise intended by providing for exchangeable handbag covers.

Along these lines, other conventional systems include handbags that can be instantly modified with different panels already attached to the handbag. For example, at least one conventional system employs ring brackets to which are attached several different handbag panels. In this example, a user changes handbag panels or covers simply by flipping the panels along the set of rings until the panel of interest is in position or otherwise displayed about the handbag cover. Of course, one will appreciate that this type of cover exchange mechanism can be inconvenient at least in part due to the extra weight of carrying all handbag covers at once. Furthermore, such systems are less than desirable since the given covers or panels will cover only a relatively limited portion of the base handbag, and do not therefore appear to appreciably change the overall look and feel of the handbag.

Accordingly, there are a number of difficulties in conventional handbags, particularly where a high degree of customization may be desired. Furthermore, there are a number of difficulties with conventional handbag cover interchanging systems that can be addressed.

BRIEF SUMMARY OF THE INVENTION

Implementations of the present invention provide systems, methods, and apparatus configured to easily modify the look and feel of any particular handbag in a manner that is highly efficient. For example, at least one implementation of the present invention includes a base handbag configured to interchange an outer-covering (also referred to as "shell," or "handbag cover"). In particular, at least one base handbag in accordance with the present invention comprises one or more fasteners, such as magnets, which facilitate a customized handbag cover of one style to be easily removed and replaced with a handbag cover of another style. The handbag cover, in turn, can be correspondingly customized with any variety of styles, and is generally small (or compressible) enough not to represent a significant storage concern. Accordingly, a user can essentially obtain the benefit of having multiple different types of base handbag styles by varying the handbag covers, and at the same time avoid the otherwise attendant costs and/or storage space needed with multiple handbags.

For example, a customizable handbag system in accordance with an implementation of the present invention can include a base handbag having a bottom portion and plurality of sides separated by at least one edge between each side and the bottom portion. The handbag system can also include a foldable handbag cover configured to conform to the bottom portion and the plurality of sides of the base handbag. In this case, the handbag cover is configured to fold along each at least one edge. In addition, the handbag system can include a plurality of fastener elements positioned on both the base handbag and the foldable handbag cover. In general, the plurality of fastener elements provide a releasable attachment point for attaching the handbag cover when folded about the base handbag.

Similarly, a handbag kit configured for customizing a handbag in accordance with the present invention can include a triangular base handbag having two opposing ends and two opposing sides. The two opposing sides pivotally extend toward or away from each other along at least one seam adjacent a bottom portion of the base handbag. The handbag kit can also include a plurality of releasable clips attached to an upper portion of the base handbag. In addition, the handbag kit can include a plurality of handles configured for releasable attachment to the releasable clips. In this case, each of the plurality of handles comprises a different aesthetic design. Furthermore, the handbag kit can include a plurality of handbag covers for folding about and releasably attaching to the base handbag. In this case, each of the handbag covers also comprises a different aesthetic design. As such, attachment of any of the plurality of handbag covers changes the aesthetic design of the base handbag from one handbag cover to the next.

In addition to the foregoing, a method of customizing a handbag in accordance with an implementation of the present invention can include detaching opposing magnetized sides of a handbag cover comprising a first design from a magnetized base handbag. The method can also include identifying a new handbag cover comprising a second design. In addition, the method can include attaching opposing sides of the new handbag cover to opposing sides of the magnetized base handbag. In this example, the new handbag cover attaches to a plurality of sides of the base handbag via magnetic forces on the two opposing sides of the base handbag.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to easily modify the look and feel of any particular handbag in a manner that is highly efficient. For example, at least one implementation of the present invention includes a base handbag configured to interchange an outer-covering (also referred to as "shell," or "handbag cover"). In particular, at least one base handbag in accordance with the present invention comprises one or more fasteners, such as magnets, which facilitate a customized handbag cover of one style to be easily removed and replaced with a handbag cover of another style. The handbag cover, in turn, can be correspondingly customized with any variety of styles, and is generally small (or compressible) enough not to represent a significant storage concern. Accordingly, a user can essentially obtain the benefit of having multiple different types of base handbag styles by varying the handbag covers, and at the same time avoid the otherwise attendant costs and/or storage space needed with multiple handbags.

One will appreciate, therefore, that implementations of the present invention provide a number of different advantages in the art. In particular, and as will be understood more fully herein, implementations of the present invention include several systems for efficiently and quickly customizing a given handbag, which include several different components and designs for enabling the same. In addition, implementations of the present invention include novel methods for easily and efficiently customizing handbags. Each of these systems, designs, and methods are discussed more fully herein.

Figure 1A:
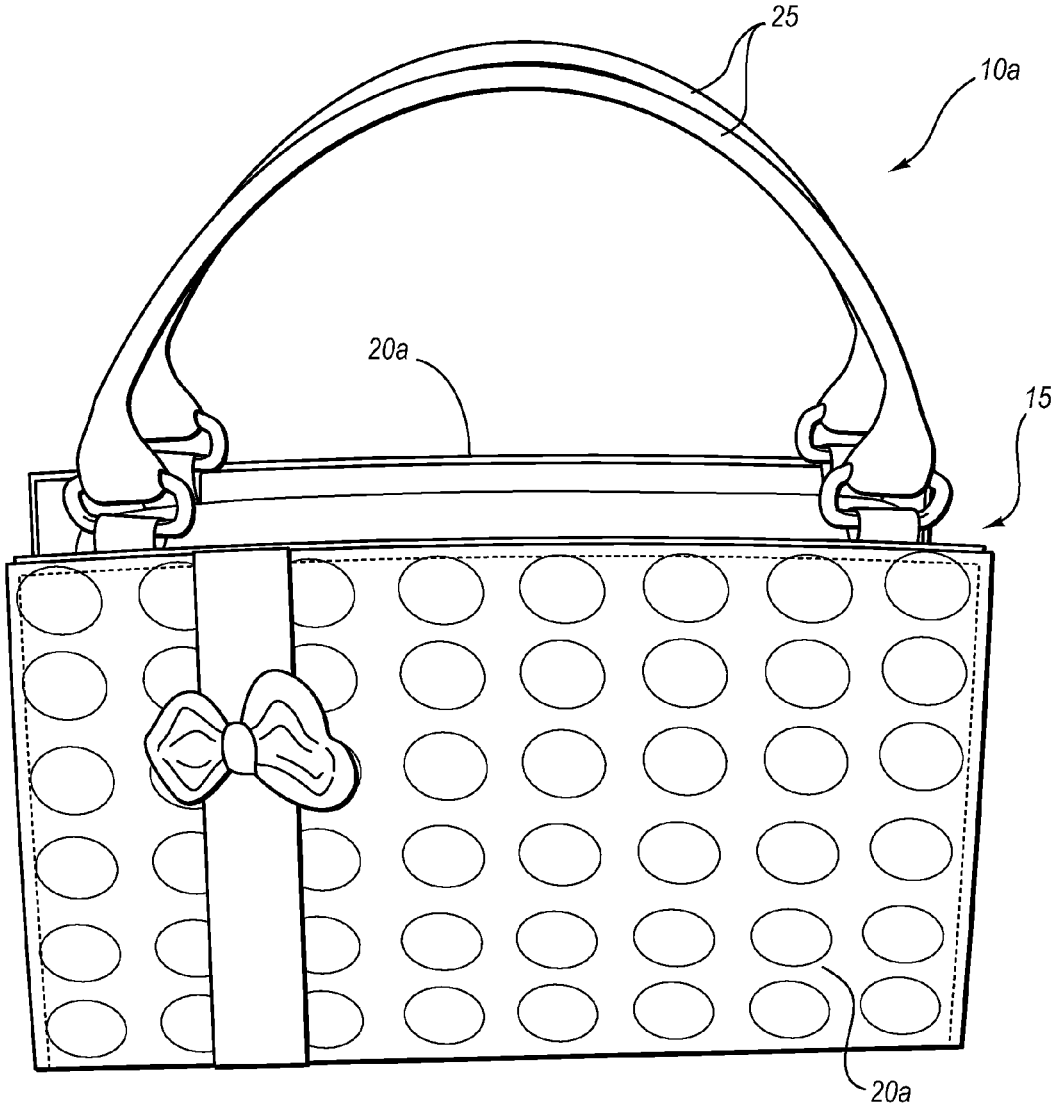
FIG. 1A illustrates a handbag in accordance with an implementation of the present invention in which an exemplary handbag cover is attached about a base handbag.
Figure 1B:
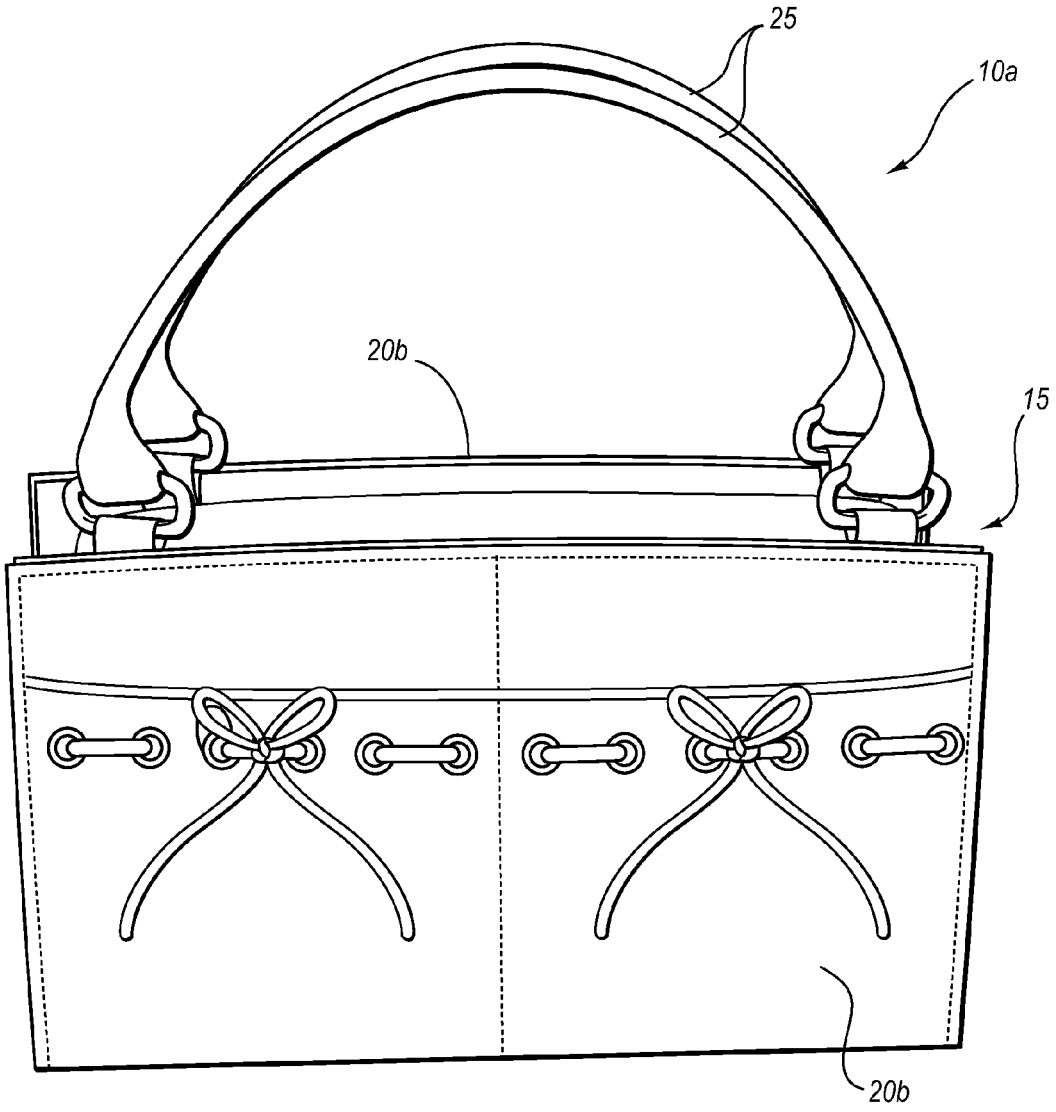
FIG. 1B illustrates a handbag in accordance with an implementation of the present invention as in FIG. 1B, albeit in which a different exemplary handbag cover is attached about the base handbag.
Figure 2A:
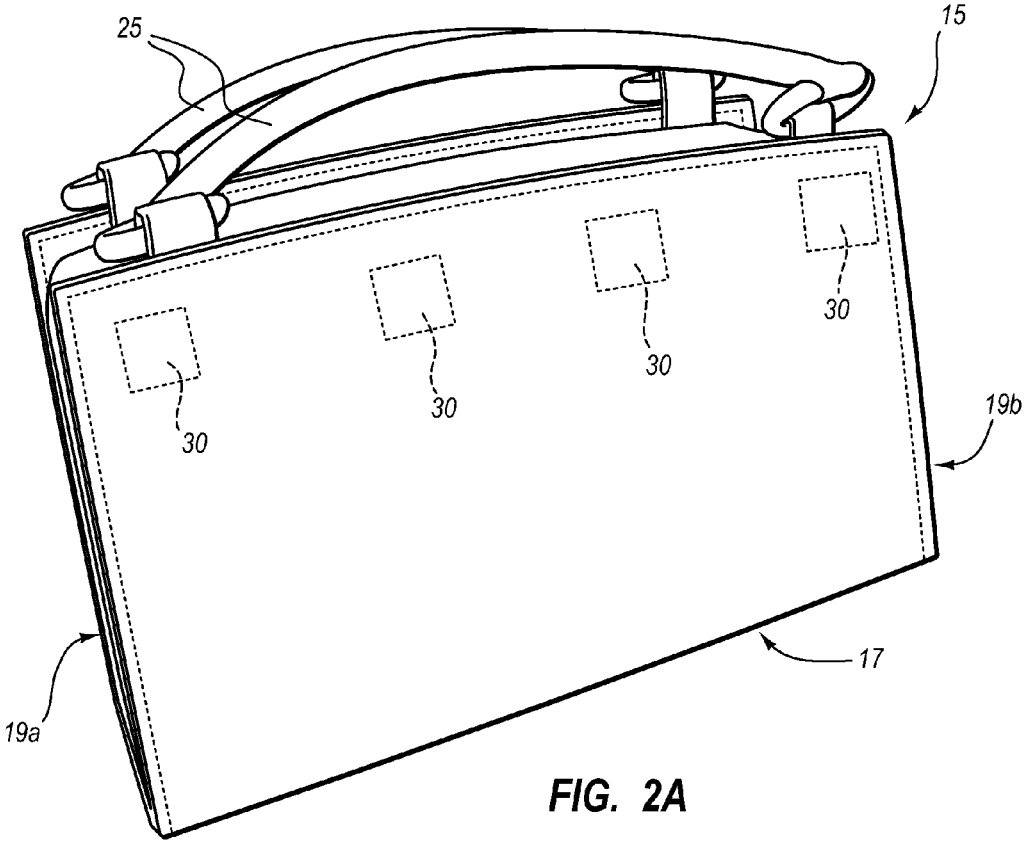
FIG. 2A illustrates a perspective view of a base handbag in accordance with an implementation of the present invention without any handbag covers.

For example, FIGS. 1A-1B illustrate a base handbag in accordance with an implementation of the present invention, as fashioned with different handbag covers (also referred to as "outer-coverings") 20*a* or 20*b*. In particular, FIG. 1A illustrates handbag 10*a* having a base handbag 15 covered with a polka-dotted handbag cover 20*a*, while FIG. 2A shows the same base handbag 15 covered with a different style of handbag cover, or cover 20*b*, thus resulting in handbag 10*b*. In this particular case, handbag cover 20*b* is effectively a single color (unlike cover 20*a*), and further comprises other decorative elements such as strings and bows not found on handbag cover 20*a*. One will appreciate, however, that this particular handbag cover 20 design is exemplary only, and any number of designs and configurations can be used within the principles of the present invention described herein.

In any event, FIG. 2A shows that a handbag 10 in accordance with one or more implementations of the present invention essentially comprises at least a base (or "base handbag") 15 to which one or more handbag covers (20) are or can be applied/affixed. In addition, FIG. 2A shows that base handbag 15 is essentially pyramidal in design. For example, FIG. 2A shows that base handbag 15 essentially comprises four sides extending from an essentially planar bottom portion 17 having four corners. The combination of sides and bottom portion, in turn, generally form a triangular shape from at least one view (e.g., FIG. 2B) when the handbag 10 is in a closed position.

Figure 2B:
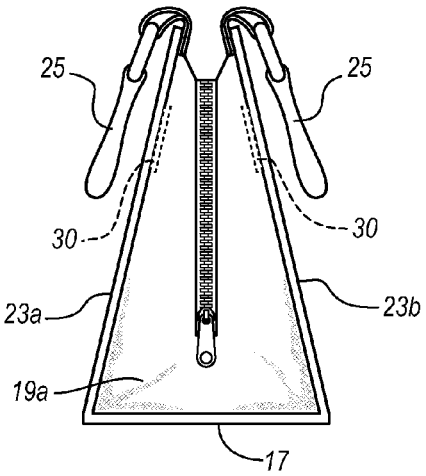
FIG. 2B illustrates a side view of the base handbag shown in FIG. 2A in which the base handbag is in a closed position.
Figure 2C:
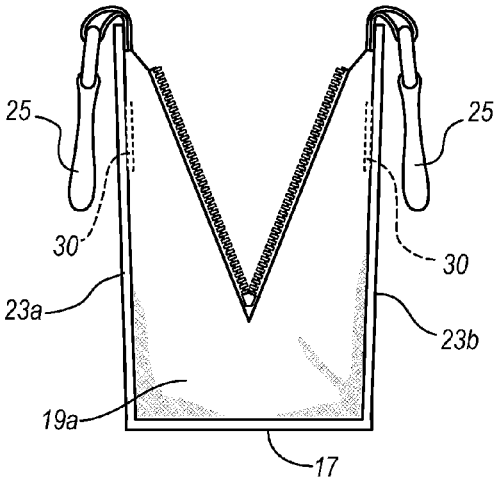
FIG. 2C illustrates the base handbag of FIG. 2B in the open position.

For example, FIGS. 2B-2C show that at least one implementation of a base handbag 15 comprises a relatively flat bottom portion 17. The bottom portion 17 is sufficiently rigid to support a plurality of ends (e.g., 19) and sides (e.g., 23). In addition, FIGS. 2A-2C show that the sides/walls 23*a-b* are also substantially rigid, and essentially planar in configuration. As a result in this particular configuration, the sides/walls 23*a-b* are supported in an upright position at least partly by bottom portion 17, in conjunction with ends 19*a-b*. In particular, opposing ends 19*a*-19*b* are at least partly flexible, thereby enabling connection between the opposing sides 23*a-b*, as well as expansion and contraction of the base handbag 15 (or opening and closing of walls 23*a-b* with respect to each other, e.g., FIGS. 2B-2C). Accordingly, base handbag 15 is configured to accommodate items being placed inside or taken out of base handbag 15, whereby the opposing sides 23*a-b* pivot toward or away from each other. In this configuration, therefore, the base handbag 15 is essentially self-supporting in an upright orientation (e.g., as shown in FIGS. 1A-5) on virtually any planar surface.

FIGS. 2A-2C further show that the base handbag 15 comprises a plurality of fastening elements 30, which typically comprise magnetic elements in at least one implementation. In the illustrated implementation, each of the magnetic fastening elements 30 are positioned within the base handbag 15 sides 23*a-b* so as to be effectively hidden from view, virtually regardless of angle. For example, each of the base handbag 15 walls 23*a-b* can comprise a substrate (not shown) having the magnetic fastening elements 30 affixed thereon, and an outer liner (i.e., the outside, illustrated surface) that is affixed about the magnets and substrate. As such, the magnetic fastening elements 30 are hidden from view in this implementation.

Of course, one will appreciate that using relatively strong but thin magnetic fastening elements 30 can provide a number of different advantages. At least one advantage of the size (i.e., thin, not protruding with respect to the base handbag surface) aspect of such exemplary magnetic elements is that they can provide the base handbag 15 with a sleek, planar attachment interface that is aesthetically pleasing on its own (i.e., without a handbag cover). At least another advantage of using relatively strong, or relatively large numbers of magnets is that such can provide sufficient attractive force through the given outer surface of the base handbag 15 in order to enable a strong attachment to the handbag cover 20, as discussed more fully hereinafter.

For example, FIG. 2A shows that base handbag 15 comprises at least 3-4 (or more) hidden, magnetic fastening elements 30. In most cases, the number or type of fastening elements 30 will correspond with the number or type of fastening elements used in the corresponding handbag cover 20, thus such an exact correlation is not required. In particular, a manufacturer can base the number, size, and dimension of the magnetic fastening elements 30 used in the base handbag 15 on any number of different factors, including overall holding/attraction strength, shape in the base handbag 15 and/or handbag cover 20, or other aesthetic or functional concerns. Furthermore, one will also appreciate that the manufacturer can use magnetic fastening elements 30 on the outside, viewable surfaces of base handbag 15 sides 23*a-b* in some implementations.

In addition, one will appreciate that magnetic forms of fastening elements 30 (or 35) are only one type of fastening element. For example, a manufacturer can also or alternatively use other forms of fastening elements 30 that include but are not limited to hook and loop elements, snap elements, and/or types of friction-based fasteners. Depending on the design and function of the given fastener, the manufacturer can then use any number or arrangement of such fasteners on the base handbag 15 and handbag cover 20 as needed to ensure an appropriate attraction with the handbag cover 20. For example, a manufacturer may use an equal number of corresponding snap-based elements on both the base handbag 15 and handbag cover 20. By contrast, and as with magnetic-based fasteners, the manufacturer may additionally or alternatively use any number or arrangement of hook and loop-based on both the base handbag 15 and the handbag cover 20. Furthermore, the manufacturer can use any combination of magnets, snaps, and hook and loop fasteners, as needed to effect the appropriate bond.

Figure 3:
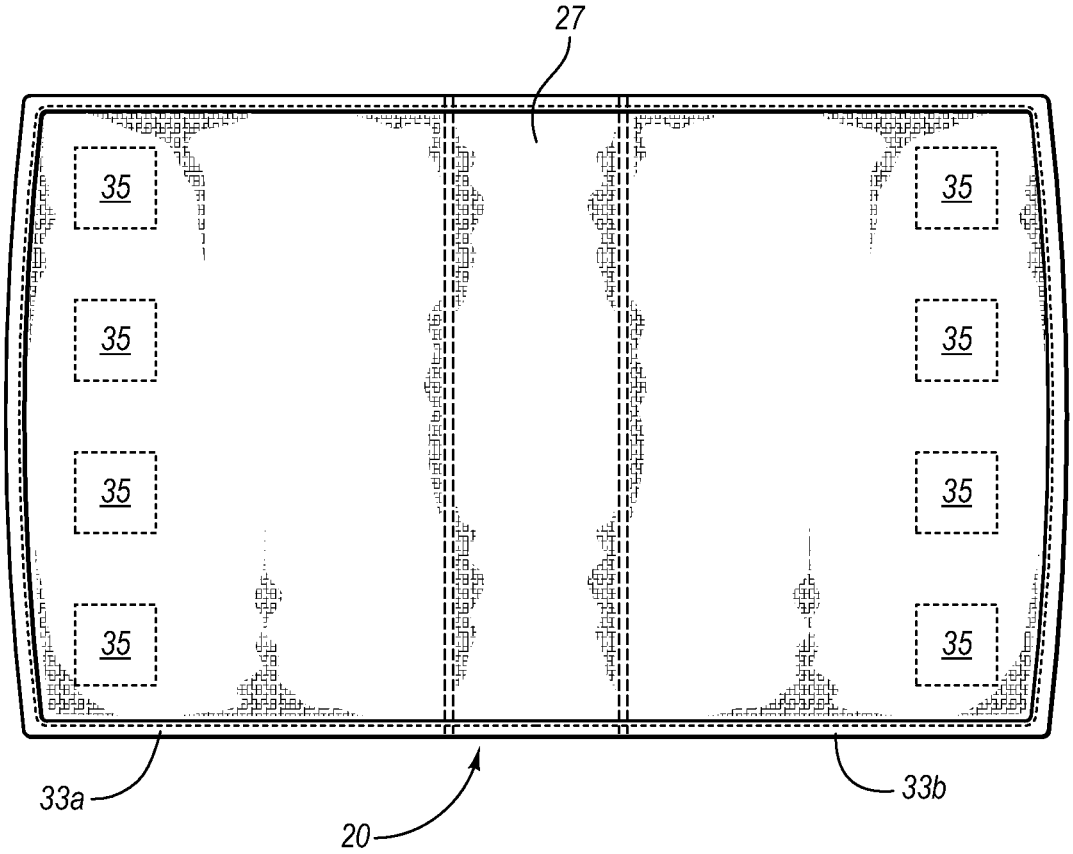
FIG. 3 illustrates a plan view of the inside surface of an exemplary handbag cover in accordance with an implementation of the present invention.

With further respect to magnetic-based fasteners, FIG. 3 illustrates an inside surface of a handbag cover 20 in accordance with an implementation of the present invention. In this example, a manufacturer has positioned or otherwise affixed at least three fastening elements 35 on or within the opposing ends 33*a-b* of the handbag cover 20. For example, as with the base handbag 15, the inner (illustrated) surface of handbag cover 20 can comprise an outer liner that is permanently affixed to a substrate comprising the magnetic fastening elements 30 positioned thereon. The magnets within the liner, therefore, are thus strong enough to exert magnetic forces through the liner, and thus cause the handbag cover 20 to attract or otherwise adhere to corresponding magnets (of fastening elements 30) of base handbag 15.

Thus, as with the base handbag 15, one will appreciate that using relatively strong but thin magnets as fastening elements 35 within handbag cover 20 can provide the combination of handbag cover 20 and base handbag 15 with a sleek, planar attachment therebetween. One will appreciate that this planar, seamless-appearing attachment between the base handbag 15 and handbag cover 20 can add to the overall aesthetic of the resulting handbag 10. For example, when sufficiently thin and strong magnetic fastening elements 35 are used (or other similarly-shaped or functioning types of fastening elements), the combination of base 15 and cover 20 appears to be a single handbag 10, rather than a combination of separable components.

One will appreciate that such unity in appearance can provide a tremendous advantage in terms of aesthetics, and hence desirability of such a bag. Furthermore, the ease by which a user can remove and add any given handbag cover 20 using a sleek, magnetic attachment interface provides a number of advantages in terms of operational efficiency.

Still other features of the base handbag 15 and handbag cover 20 components can add to the efficiency and desirability of the overall handbag. For example, FIG. 3 shows that a handbag cover 20 in accordance with implementations of the present invention can essentially comprise a unitary component that can be stretched out into a thin, planar conformation. One will appreciate that such a thin, planar alignment can be stored without difficulty.

Figure 4A:
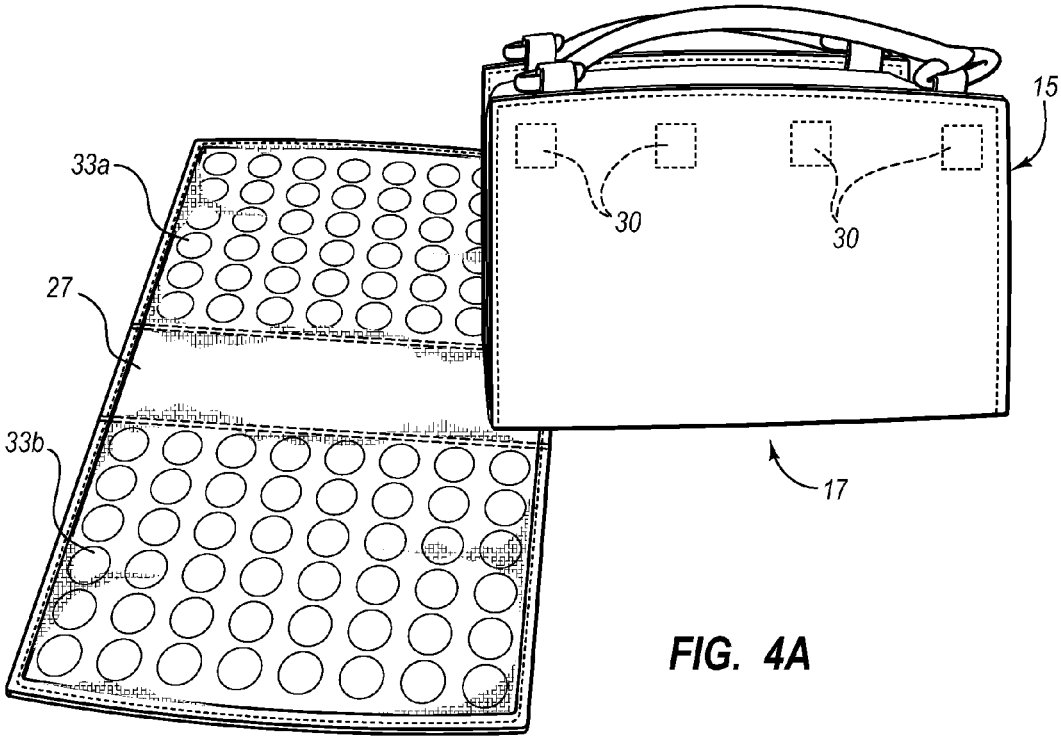
FIG. 4A illustrates a perspective view of a base handbag adjacent a handbag cover in accordance with an implementation of the present invention, wherein the handbag cover is shown in an expanded or storage position.
Figure 4B:
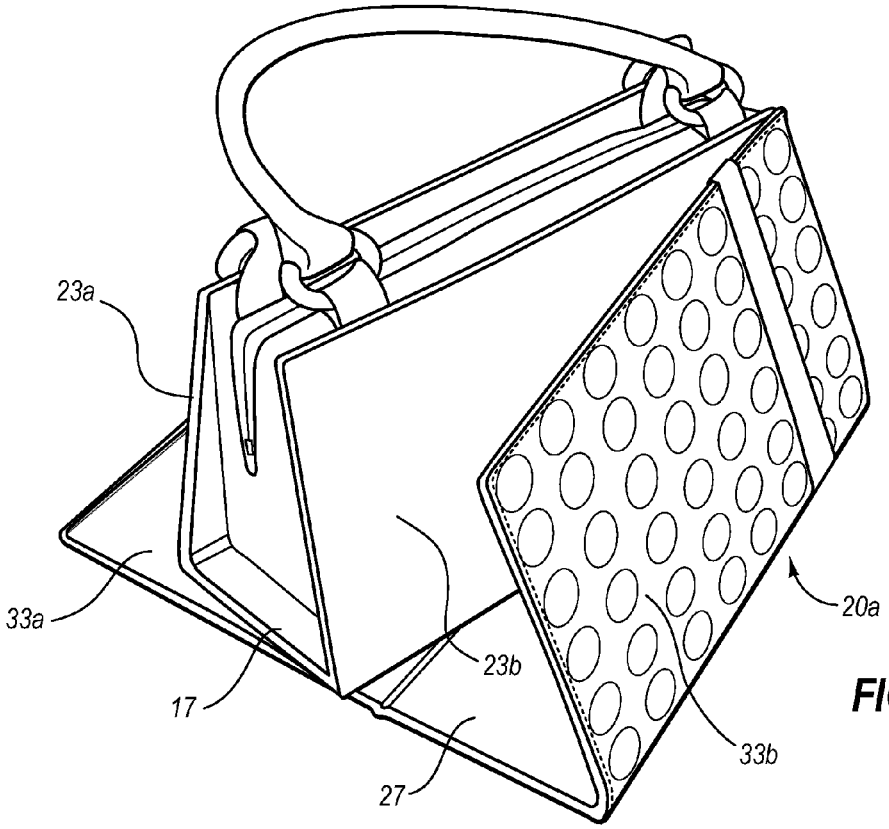
FIG. 4B illustrates a perspective view of the base handbag and handbag cover shown in FIG. 4A in which the handbag cover is being positioned and attached about the base handbag.

In addition, FIG. 3 (see also FIG. 4B) shows that at least one implementation of a handbag cover 20 comprises left and right sides 33*a-b* that can fold about bottom portion 27 along corresponding creases or seams. In one implementation, therefore, the handbag cover of FIG. 3 can be thought of as a "tri-fold" handbag cover 20. In any event, the handbag cover 20 illustrated or described herein is configured to fold and thus conform to the dimensions or design of the given base handbag 15. For example, as shown in FIGS. 4A and 4B, the bottom portion 27 of each handbag cover is configured in size and shape to align directly with the bottom portion 17 of the base handbag 15. In addition, the creases and seams adjacent bottom portion 27 of cover 20 will align with the bottom edges adjacent the bottom portion 27 of the base handbag 15. Accordingly, the illustrated handbag cover 20 is specifically designed and shaped to conform to a range of essentially-triangular base handbag 15 shapes.

Of course, one will appreciate that in at least one implementation of the present invention, the sides 33*a-b* of handbag cover 20 are interchangeable with regard to a given base handbag side 23*a-b*. For example, side 33*a* of handbag cover 20 can be positioned against side 23*a* or side 23*b* of base handbag 15. Furthermore, the position of the handbag cover 20 sides 33 can be varied with respect to any given lateral or horizontal position of the base handbag 15. For example, in an implementation of the base handbag 15 and handbag cover 20 using magnetic or hook and loop fastening elements 30, 35, the user can position the sides 33*a-b* against side 23*a-b* at almost any spatial position, whether perfectly or imperfectly aligned with each edge of base handbag 15, so long as there is sufficient bonding strength between the corresponding fasteners in the base handbag 15 and handbag cover 20. One will appreciate that this ability to quickly and inexactly align the base handbag 15 and handbag cover 20 allows the user still additional creativity in decorating a given base handbag 15. This variability further allows the user certain flexibility and convenience in quickly but imperfectly assembling a base handbag 15 when the user may be in a hurry.

As shown in FIG. 4B, assembly of the base handbag 15 and handbag cover 20 is relatively simple. In particular, FIGS. 4A and 4B show that the user can simply lay the handbag cover 20(*a*) on a support surface with handbag cover in a laid-out or stretched out conformation. For example, FIG. 4A shows that handbag cover 20*a* is stretched out with respect to the base handbag 15, and with the design side facing upward. Prior to assembly, however, the user will have the inner surface facing upward.

For example, FIG. 4B shows that the user can face the inner surface of the handbag cover 20 upward, and then align or otherwise position the bottom portion 17 of base handbag 15 on top of bottom portion 27 of handbag cover 20*a*. The user can then fold or arrange the sides 33*a-b* along the creases or seams with portion 27 until the sides 33*a-b* contact or are otherwise attracted to sides 23*a-b* of base handbag 15. In this conformation, the creases or seams of handbag cover 20 will align with the bottom edges of the base handbag 15 with respect to bottom portion 17. In any event, and as previously mentioned, folding the cover sides 33*a-b* upward against handbag sides 23*a-b* causes the fastening elements 30 and 35 to engage. With respect to magnetic forces, for example, the attraction between handbag cover 20 and base handbag 15 causes sides 33*a-b* to bond to sides 23*a-b*. This bond will generally remain through a variety of different uses and attendant stresses until the user simply peels the handbag cover 20 away from base handbag 15.

Figure 5:
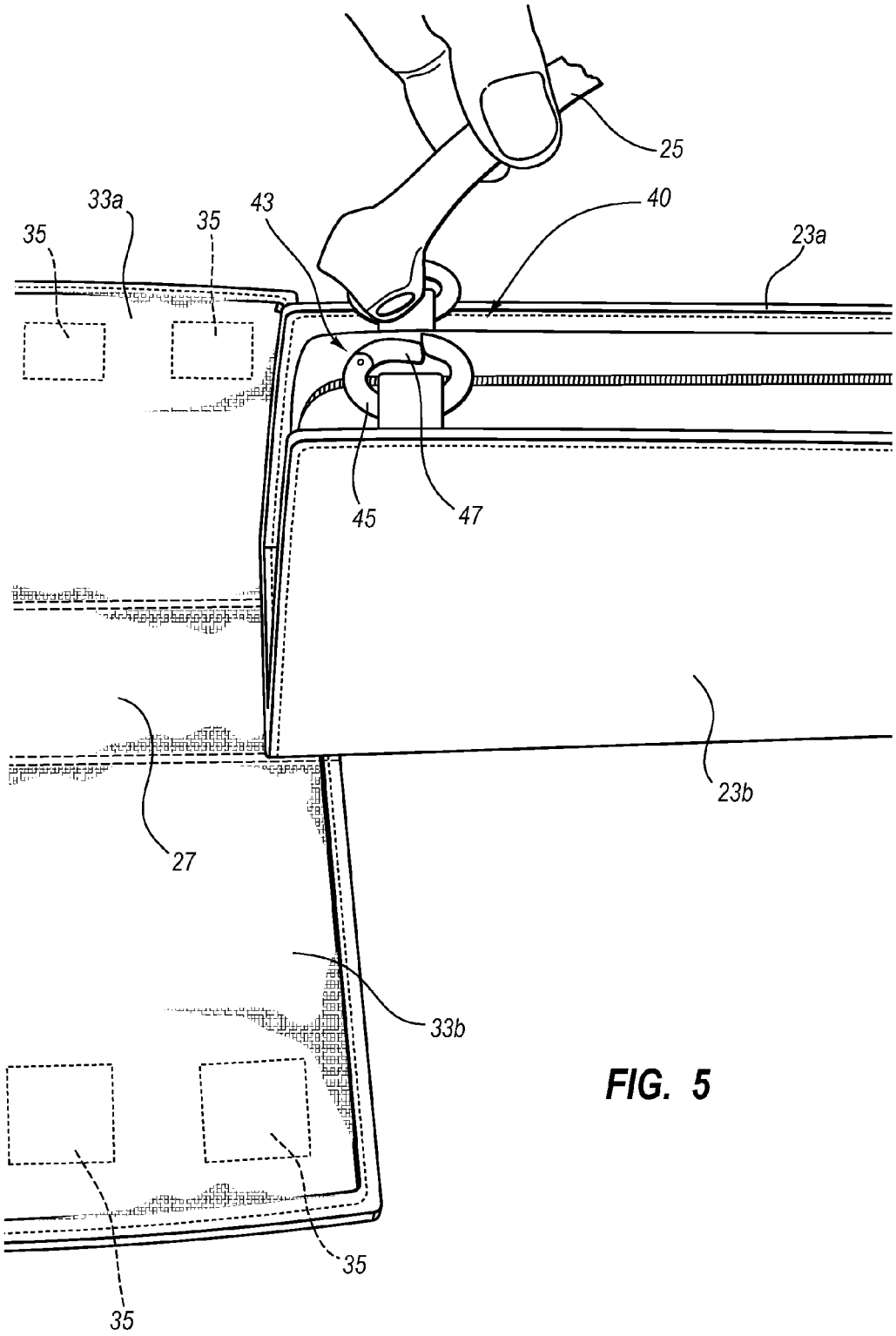
FIG. 5 illustrates a perspective view of a base handbag in which one or more handles are removable therefrom in accordance with an implementation of the present invention.

FIG. 5 illustrates another implementation of a base handbag 15 in accordance with an implementation of the present invention in which the base handbag 15 includes releasable clips for removing or replacing the base handbag handle(s) 25. For example, FIG. 5 shows that a base handbag 15 can include one or more releasable handle clips 40 (e.g., carabineer-style), which comprise a general ring body 45 having a flexible hinge 43 therein. FIG. 5 further shows that the hinge 43 can be connected to a tongue portion 47, which a user can depress or otherwise release with respect to the main ring body 45. As a result, a user can push in the releasable clip 40, upon which the user can slide out a connected end of a given handle 25. Of course, other types of release mechanisms may be used in accordance with the principles of the present invention.

In any event, one will appreciate that the ability to interchange a given handle 25 or set of handles from base bag 15 can provide yet additional configurability and flexibility with the handbag 10 described herein. In particular, the ability to interchange handles 25 further allows for different sizes and colors of handles to be used for each bag 10, and thus a different level of customization beyond just customizing the bag cover(s) 20.

Accordingly, one will appreciate that a variety of different bag re-design and reconfiguration systems can be implemented in accordance with one or more implementations of the present invention. For example, at least one system for interchanging the look and feel of a given handbag 10 comprises a base handbag 15, one or more handbag covers 20, and one or more interchangeable handbag handles 25 configured to attach and/or detach from one or more corresponding releasable handle clips 40. In this system, the one or more handbag covers 20 comprise a series of fasteners 35 that correspond with fasteners 30 on the base handbag 15, and provide for a sleek or narrow attachment between the handbag cover and base handbag. In one implementation, the system is configured so that the base handbag can be interchanged with a wide range of handbag covers simply by peeling off (or otherwise removing) one cover and easily adhering another handbag cover to the base handbag.

In at least one implementation, the above-described system can also be used in conjunction with any number or type of fasteners. For example, in at least one implementation, the base handbag 15 and handbag covers 20 are configured with corresponding magnet-c fastening elements to facilitate attachment (e.g., adhering and peeling-off attachment functionality) between the base handbag 15 and handbag cover 20. In such an implementation, the magnets are typically quite thin (i.e., only a few mils in thickness) in order to create a sleek, relatively seamless attachment interface. For example, the magnets (i.e., fastening elements 30, 35) are positioned so as to be concealed within a wall/side of the base handbag and within an inside surface of the handbag cover 20.

In additional or alternative implementations, however, the base handbag 15 and handbag cover(s) 20 additionally or alternatively include one or more other types of fastener elements. For example, the system can be configured with hook and loop fasteners, snap-based fasteners, or the like, as previously described. In either case, the fasteners are configured so that the attachment interface between base handbag 15 and handbag cover 20 is essentially indistinguishable, and the combination of components appears as a single handbag with no attachments.

Similarly, and in addition to the foregoing, a handbag kit in accordance with an implementation of the present invention comprises at least one base handbag 15. The handbag kit also comprises a plurality of attachable/detachable handbag covers 20 of a plurality of different styles and/or colors. In additional or alternative implementations, the handbag kit further comprises a plurality of detachable and re-attachable handles of a plurality of different styles corresponding to the styles of the plurality of handbag covers 20. Along these lines, the handbag kit further comprises a plurality of interchangeable, releasable handle clips 40 that have a flexible hinge 43 therein. In at least one implementation, the base handbag 15 and handbag covers 20 are further configured with a plurality of magnetic fastener elements 30, 35 for removably attaching the base handbag 15 to any one of the handbag covers 20.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A handbag kit configured for customizing a handbag comprising:

a base handbag having a substantially triangular cross section, the base handbag having two opposing ends and two opposing sides, the two opposing sides being able to pivotally extending toward or away from each other;

a plurality of releasable clips attached to an upper portion of the base handbag;

a plurality of handles configured for releasable attachment to the releasable clips;

a plurality of tri-fold handbag covers, each handbag cover being configured to fold about and attract to the base handbag as each cover is moved toward contact with the base handbag, wherein each of the handbag covers comprises at least one surface with a different aesthetic design, each handbag cover also being configured to be able to lie substantially flat; and a plurality of magnet fastener elements attached to at least one of the base handbag and each handbag cover;

wherein attachment of any of the plurality of handbag covers changes the aesthetic design of the base handbag from one handbag cover to the next, and wherein each of the magnet fastener elements is hidden from view after attachment of a handbag cover to the base handbag.

2. The handbag kit as recited in claim 1, wherein:

each foldable handbag cover is configured to fold along a crease adjacent a bottom portion of each foldable handbag;

the crease of each handbag cover is configured to align with at least one edge of the base handbag; and each foldable handbag cover is configured to fold to conform to the shape of the base handbag.

3. The handbag kit as recited in claim 1, wherein only one of the base handbag and each handbag cover comprises magnet fastener elements for releasably attaching the handbag cover and the base handbag together.

4. The handbag kit as recited in claim 3, wherein the other of the base handbag and each of the handbag cover includes corresponding fastener elements to which the magnet fastener elements are attractable.

5. The handbag kit as recited in claim 1, wherein both the base handbag and each handbag cover include magnet fastener elements.

6. The handbag kit as recited in claim 5, wherein:

a first plurality of the magnetic fastener elements is positioned within a liner on opposing sides of the base handbag, and a second plurality of magnetic fastener elements is positioned within a liner on a corresponding handbag cover;

wherein all of the magnetic fastener elements are hidden from view before attachment of the corresponding handbag cover to the base handbag.

* * * * *